US012370399B1

(12) United States Patent
Gong et al.

(10) Patent No.: US 12,370,399 B1
(45) Date of Patent: Jul. 29, 2025

(54) MULTIFUNCTIONAL FITNESS PAD

(71) Applicant: Ningbo Danshui Trading Co., Ltd, Zhejiang (CN)

(72) Inventors: Hengjie Gong, Zhejiang (CN); Jifeng Xu, Zhejiang (CN); Fenghai Xu, Zhejiang (CN)

( * ) Notice: Subject to any disclaimer, the term of this patent is extended or adjusted under 35 U.S.C. 154(b) by 0 days.

Patent file contains an affidavit/declaration under 37 CFR 1.130(b).

(21) Appl. No.: 18/980,315

(22) Filed: Dec. 13, 2024

(51) Int. Cl.
*A63B 23/04* (2006.01)
*A63B 21/00* (2006.01)
*A63B 23/035* (2006.01)

(52) U.S. Cl.
CPC ..... *A63B 21/4029* (2015.10); *A63B 21/4034* (2015.10); *A63B 21/4047* (2015.10); *A63B 23/03525* (2013.01); *A63B 23/04* (2013.01); *A63B 2225/093* (2013.01)

(58) Field of Classification Search
CPC ..... A63B 21/4029; A63B 21/4031; A63B 21/4034; A63B 21/4047; A63B 23/04; A63B 23/03525; A63B 23/0494; A63B 2225/093
See application file for complete search history.

(56) References Cited

U.S. PATENT DOCUMENTS 4,582,320 A * 4/1986 Shaw ..... A63B 21/4035 482/130
4,911,436 A * 3/1990 Lighter ..... A63B 21/4047 482/138
5,733,233 A * 3/1998 Webber ..... A63B 21/4047 482/142
5,980,434 A * 11/1999 Webber ..... A63B 23/0494 482/145
6,299,568 B1 * 10/2001 Prok ..... A63B 23/00 482/93
6,755,770 B2 * 6/2004 Martens ..... A63B 21/072 482/99
10,792,535 B2 * 10/2020 Chou ..... A63B 1/00
12,036,436 B2 * 7/2024 Henniger ..... A63B 21/4029
2004/0162195 A1 * 8/2004 Habing ..... A63B 23/1254 482/138
2014/0031182 A1 * 1/2014 Donofrio ..... A63B 21/0552 482/129
2015/0011370 A1 * 1/2015 Henniger ..... A63B 23/0211 482/145
2015/0367168 A1 * 12/2015 Henniger ..... A63B 21/4029 482/145
2019/0275363 A1 * 9/2019 Jones ..... A63B 21/0616
(Continued)

OTHER PUBLICATIONS

PRX Performance "PRX Leg Curl/Extension"; https://prxperformance.com/products/axis-pad-extension-leg-curl; Jul. 25, 2024 (Year: 2024).*
(Continued)

*Primary Examiner* — Joshua T Kennedy
(74) *Attorney, Agent, or Firm* — Hawaii Patent Services; Nathaniel K. Fedde; Kenton N. Fedde

(57) ABSTRACT

A multifunctional fitness pad comprising an attachment part, a support part, and a leg exercise part, wherein the support part is pivotally connected to the attachment part to change the support angle for users; and the leg exercise part provides a leg exercise function.

13 Claims, 4 Drawing Sheets

(56) References Cited

U.S. PATENT DOCUMENTS

| | | | | |
|---|---|---|---|---|
| 2020/0222745 | A1* | 7/2020 | Leipheimer ..... | A63B 23/03525 |
| 2024/0165458 | A1* | 5/2024 | Nesbit ..... | A63B 21/4034 |

OTHER PUBLICATIONS

TITAN Fitness; "TITAN Series Rack Mounted Leg Curl and Extension"; https://titan.fitness/products/titan-series-rack-mounted-leg-curl-extension; Mar. 6, 2022 (Year: 2022).*

PRX Performance; PRX Axis Pad; "https://prxperformance.com/products/prx-axis-pad"; May 5, 2024 (Year: 2024).*

BodyKore; Leg Extension/Curl Seat Attachmetn MX1175; "https://www.bodykore.com/product/leg-extension-curl-seat-attachment-mx1175"; Jan. 6, 2024 (Year: 2024).*

Bullet Proof; Isolator 2×2/2×3; "https://bulletprooffitnessequipment.com/products/test-2"; Feb. 5, 2024 (Year: 2024).*

Inventor-Originated Disclosure (See 130 Declaration): "Major Fitness Rack Mounted Leg Extension" (major-lutie.com) Jan. 15, 2024 Obtained from the internet URL:<https://www.major-lutie.com/products/rack-mounted-leg-extension>. Downloaded on Dec. 13, 2024.

* cited by examiner

MULTIFUNCTIONAL FITNESS PAD

TECHNICAL FIELD

The present disclosure relates to the technical field of fitness equipment, particularly to a multifunctional fitness pad.

BACKGROUND

At present, most of the fitness equipment on the market often has the defects such as single function, large floor space, inconvenient carrying and so on, which can hardly meet the needs of people for diversified fitness training in a limited space.

The existing trainers, for example, U.S. Pat. No. 11,707,642, No. 1183390 and No. 9895565, as well as U.S. Patent Application No. US20170304677A1 has proposed various kinds of exercise methods, but most of them are simple. Although there are some ways to realize multifunction by adjusting the height or angle of the mechanism, as in No. 1183390, its function is limited. These devices primarily only change the user's posture and uses the user's weight to achieve the purpose of exercise, and cannot enhance the exercise effect with counterweights.

There are posture-changeable exercisers combined with counterweights in the prior art, but these devices all have the problems of large occupied space, inflexibility, and the like. Therefore, a multifunctional fitness pad is proposed.

SUMMARY

The present disclosure provides a multifunctional fitness pad, which can significantly improve users' fitness experience and exercise effect through multi-angle support, increasing leg exercise resistance, small occupied space, simple operation, versatile exercises, and high adjustability.

The present disclosure includes an attachment part, a support part, a releasable locking mechanism, and a leg exercise part. The attachment part is selectively attached to one of a plurality of selectable height positions on a gym rack; the support part includes a support arm and a pad body, wherein the pad body is disposed on the support arm for supporting a user, and the support arm extends transversely relative to the attachment part and is pivotally connected to the attachment part to change a support angle for the user; the releasable locking mechanism is disposed between the attachment part and the support part and configured for locking the support arm to a required support angle; the leg exercise part includes an engagement seat and a leg exercise piece, wherein the engagement seat is mounted on the support arm, and the leg exercise piece is pivotally connected to the engagement seat to provide a leg exercise function; and a connecting part is disposed on the leg exercise piece for being selectively connected to a gym rack resistance system by the user to increase a pivoting resistance of the leg exercise piece during leg exercise.

The attachment part includes a mounting seat attachable to the gym rack and an extension arm extending transversely relative to the mounting seat, and the support arm is pivotally connected to an end of the extension arm far away from the mounting seat. The mounting seat includes a mounting frame and a positioning pole disposed on the inner side of the mounting frame, and the mounting frame is detachably connected with a movable pin, so as to be adjusted at different positions. The extension arm is provided with an avoidance hole. A first T-shaped frame is detachably mounted on the extension arm, and the two sides of the first T-shaped frame are provided with first protective foams.

The attachment part on one end of a support arm is pivotally connected to the attachment part, the other end is provided with a telescopic movable arm, and the engagement seat is mounted on the support arm through the movable arm.

The support arm is sleeved outside the movable arm. The movable arm has a plurality of positioning holes along a telescoping direction. The support arm is provided with a locking bolt which can be inserted into one of the positioning holes to lock a protruding length of the movable arm. A second T-shaped frame is disposed on the engagement seat, and the two sides of second T-shaped frame are provided with second protective foams.

The leg exercise piece includes a third T-shaped frame, which consists of a swingarm and a crossbar, wherein the swingarm is rotatably connected to the engagement seat through a pivot shaft, and a middle part of the crossbar is mounted on the swingarm; and the two sides of the crossbar extend to the outside of the swingarm, and the two sides of the crossbar are provided with third protective foams. The swingarm is provided with a plurality of mounting positions for mounting the crossbar along a length direction, and the crossbar is detachably mounted in any mounting position. Aside rom the engagement seat near the swingarm is provided with a buffer pad for buffering the impact from the swingarm.

The connecting part includes a buckle hole disposed on the leg exercise piece, and the buckle hole is configured to connect a resistance system to increase the pivoting resistance of the leg exercise piece. The releasable locking mechanism includes a locking disc disposed on the support part and a clamping pin disposed on the attachment part, and a plurality of pivot holes for inserting the clamping pin is provided on the locking disc along a rotation direction of the support part.

The present disclosure further provides a multifunctional gym rack, which includes the above multifunctional fitness pad, and further consists of a gym rack provided with a plurality of selectable height position mounting positions; and a resistance system mounted on the gym rack and configured for providing a resistance for an exercise carried out on the gym rack.

BRIEF DESCRIPTION OF DRAWINGS

In order to explain the technical solution of this application more clearly, the drawings needed for its implementation will be briefly introduced below. The drawings described below are only some implementations of this application. For those skilled in the art, additional drawings can be obtained according to these drawings without creative work.

Figure 1:
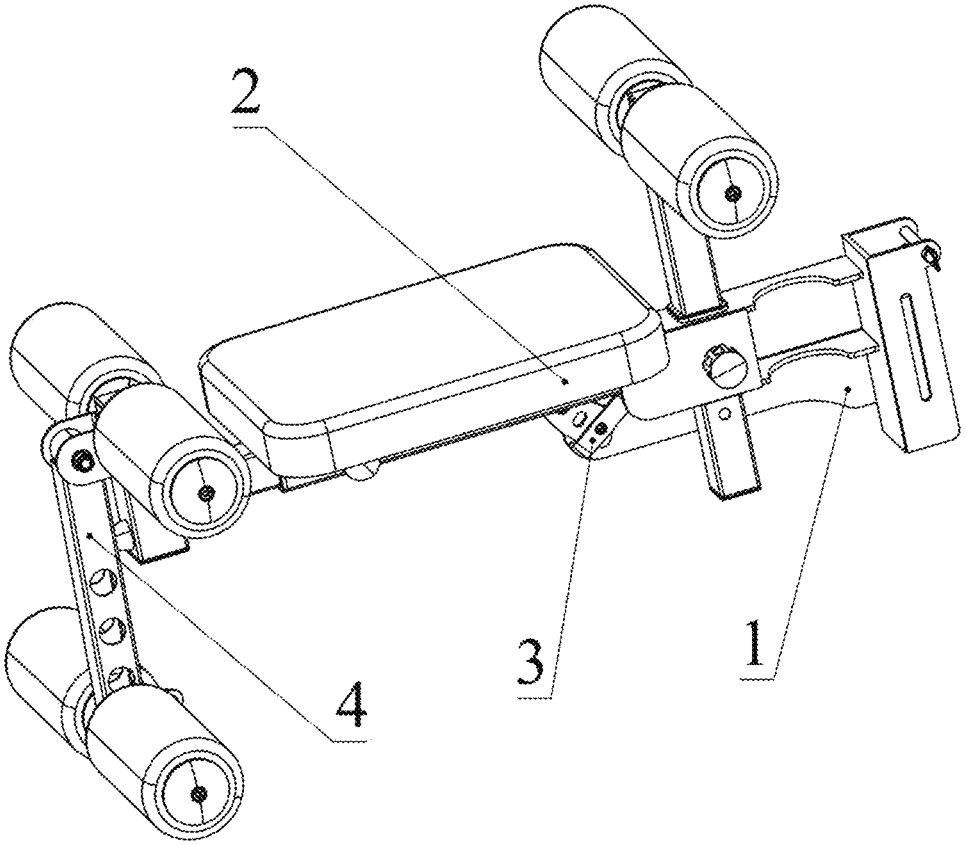
FIG. 1 is a schematic diagram of the overall structure of the multifunctional fitness pad of the present disclosure.

In the picture:

Attachment part (1); Support part (2); Releasable locking mechanism (3); Leg exercise part (4); Mounting frame (11); Extension arm (12); Positioning pole (13); Movable bolt (14); Avoidance hole (15); First T-shaped frame (16); First protective foam (17); Support arm (21); Pad body (22); Movable arm (23); Positioning hole (24); Locking bolt (25); Locking disc (31); Clamping pin (32); Engagement seat (41); Leg exercise piece (42); Second T-shaped frame (43); Second protective foam (44); swingarm (45); Crossbar (46); Third protective foam (47); Mounting position (48); Buffer pad (49); Buckle hole (51).

DESCRIPTION OF EMBODIMENTS

The technical solution in the application's embodiment will be clearly and completely described below with reference to the drawings in the embodiment of the application. The described embodiment is only part of, rather than all of the embodiments of the application. Based on the embodiments in this application, all other embodiments obtained by those skilled in the art without creative labor belong to the protection scope of this application.

Reference to "an example" or "an embodiment" herein means that a particular feature, structure or characteristic described in connection with an embodiment or an embodiment can be included in at least one embodiment of this application. The appearance of this phrase in various places in the specification does not necessarily refer to the same embodiment, nor is it an independent or alternative embodiment mutually exclusive with other embodiments. It is understood explicitly and implicitly by those skilled in the art that the embodiments described herein can be combined with other embodiments.

In this specification, for the sake of convenience, words and expressions indicating orientation or positional relationship such as "middle", "upper", "lower", "front", "rear", "vertical", "horizontal", "top", "inner" and "outer" are used to illustrate the positional relationship of constituent elements with reference to the attached drawings, only for the convenience of description. The positional relationship of the constituent elements is appropriately changed according to the direction of the described constituent elements. Therefore, it is not limited to the words and expressions described in the specification and can be replaced appropriately depending on the situations.

As shown in FIGS. 1 to 5, the present disclosure provides a multifunctional fitness pad, which includes an attachment part 1 that is selectively attached to one of a plurality of selectable height positions on a gym rack; a support part 2 including a support arm 21 and a pad body 22, wherein the pad body 22 is disposed on the support arm 21 for supporting a user, and the support arm 21 extends transversely relative to the attachment part 1 and is pivotally connected to the attachment part 1 to change a support angle for the user; a releasable locking mechanism 3 disposed between the attachment part 1 and the support part 2 and configured for locking the support arm 21 to a required support angle; a leg exercise part 4 including an engagement seat 41 and a leg exercise piece 42, wherein the engagement seat 41 is mounted on the support arm 21, and the leg exercise piece 42 is pivotally connected to the engagement seat 41 to provide a leg exercise function; and a connecting part is disposed on the leg exercise piece for being selectively connected to a gym rack resistance system by the user to increase a pivoting resistance of the leg exercise piece 42 during leg exercise.

Figure 2:
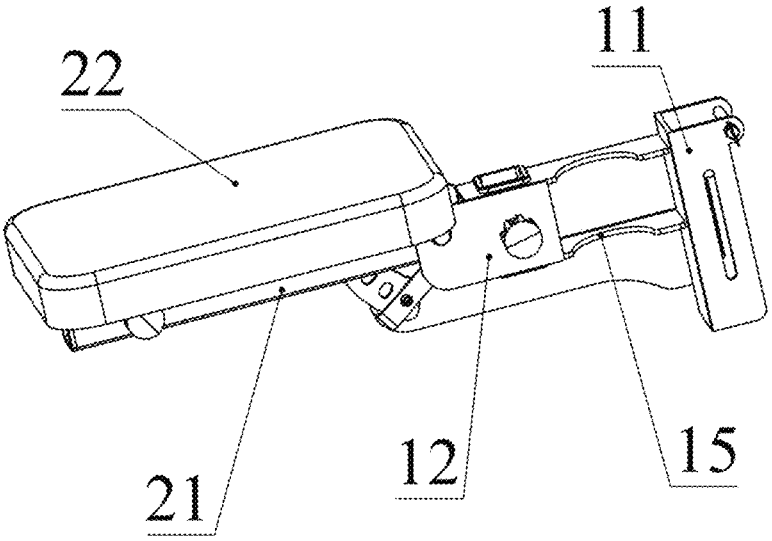
FIG. 2 is a partial structural diagram of FIG. 1.
Figure 3:
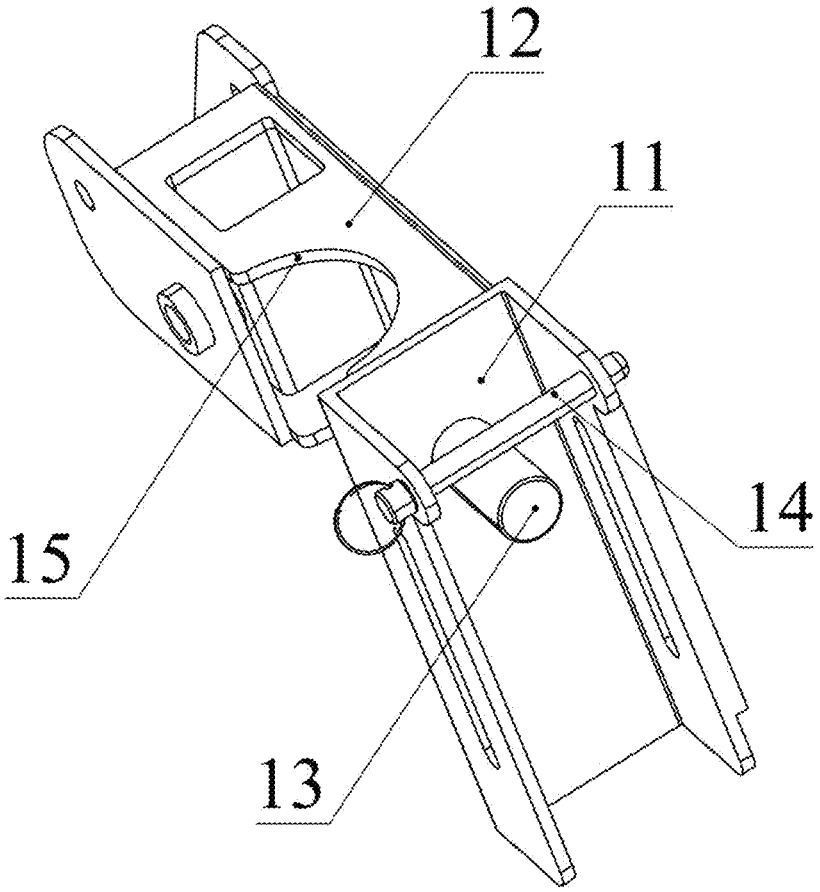
FIG. 3 is a partial structural diagram of the attachment part of FIG. 1.

As shown in FIGS. 2 to 3, the attachment part 1 includes a mounting seat attachable to the gym rack and an extension arm 12 extending transversely relative to the mounting seat, and the support arm 21 is pivotally connected to an end of the extension arm 12 far from the mounting seat. The mounting seat consists of a mounting frame 11 and a positioning pole 13 disposed on the inner side of the mounting frame 11, and a movable pin 14 is detachably connected to the mounting frame 11 for facilitating installation and disassembly. A first T-shaped frame 16 is detachably mounted on the extension arm 12, and the two sides of the first T-shaped frame 16 are provided with first protective foams 17 for supporting and protecting the back of a user sitting on the pad body 22. In addition, the extension arm 12 is provided with an avoidance hole 15, which is used for the cable of the resistance system of the gym rack to pass through, thus ensuring the safety and convenience in use. In some embodiments (not shown in), the user can design the first T-frame 16 as a modular assembly so that the user can replace different types of support frames or protective foam as required.

Figure 4:
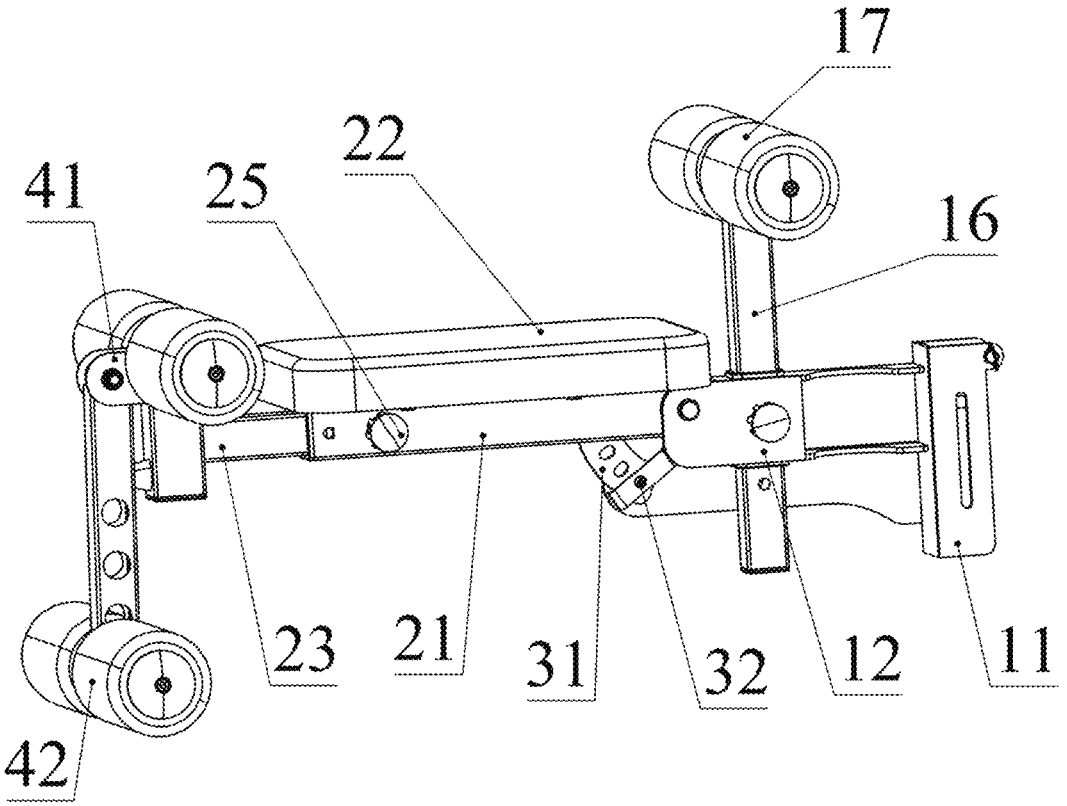
FIG. 4 is another schematic view of the overall structure of FIG. 1.

As shown in FIGS. 2 to 4, one end of the support arm 21 is pivotally connected to the attachment part 1, and the other end is provided with a telescopic movable arm 23, and the engagement seat 41 is mounted on the support arm 21 through the movable arm 23. The support arm 21 is sleeved outside the movable arm 23, and the movable arm 23 is provided with a plurality of positioning holes 24 along the telescoping direction. The support arm 21 is provided with a locking bolt 25, which can be inserted into any positioning hole 24 to lock the protruding length of the movable arm 23. The engagement seat 41 is provided with a second T-shaped frame 43, and the two sides of the second T-shaped frame 43 are provided with second protective foams 44 for supporting and protecting the thighs of users sitting on the pad body 22. This design not only overcomes the shortcomings of limited adjustment range of existing fitness equipment but also enhances the comfort and safety of use.

Figure 5:
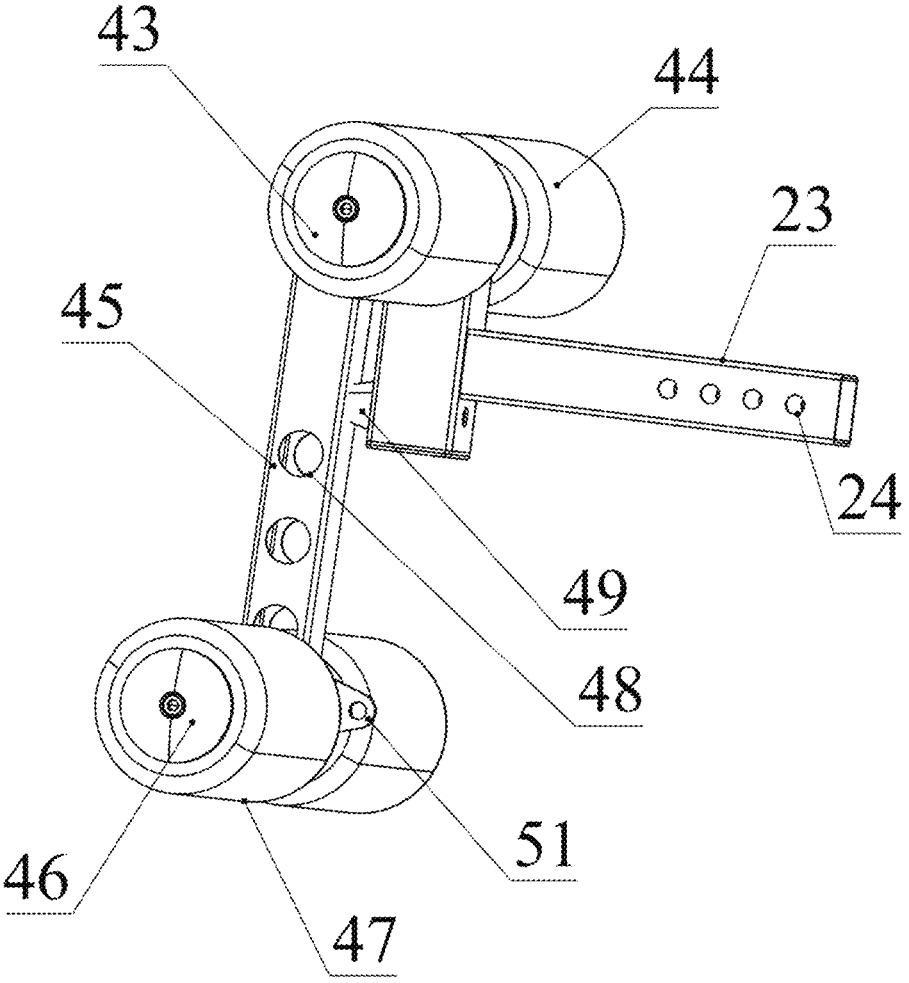
FIG. 5 is a partial structural diagram of FIG. 1.

As shown in FIG. 4 to FIG. 5, the leg exercise piece 42 includes a third T-shaped frame, which includes a swingarm 45 and a crossbar 46. The swingarm 45 is rotatably connected to the engagement seat 41 through a pivot shaft, the middle part of the crossbar 46 is mounted on the swingarm 45, and both sides of the crossbar 46 extend to the outside of the swingarm 45. The two sides of the crossbar 46 are provided with third protective foams 47, which are used for fitting with the legs of users sitting on the pad body 22. The swingarm 45 is provided with a plurality of mounting positions 48 along the length direction for mounting the crossbar 46, and the crossbar 46 is detachably mounted in any of the mounting positions 48. The side of the engagement seat 41 near the swingarm 45 is provided with a buffer pad 49 for buffering the impact from the swingarm 45. In some embodiments (not shown), springs or cushioning devices are integrated in the cushioning pad 49 to provide better shock absorption effect and comfort.

The connecting part includes a buckle hole 51 disposed on the leg exercise piece 42. The buckle hole 51 connects a resistance system to increase the pivoting resistance of the leg exercise piece 42.

As shown in FIG. 4, the releasable locking mechanism 3 includes a locking disc 31 disposed on the support part 2 and a clamping pin 32 disposed on the attachment part 1, and the locking disc 31 is provided with a plurality of pivot holes for inserting the camping pin 32 along the rotation direction of the support part 2. With the design of the releasable locking mechanism 3, the support arm 21 can be quickly locked to a required support angle, which is convenient for users to adjust quickly in different exercise processes. This design improves the user's experience and solves the problems of complicated operation and inconvenient adjustment of existing fitness equipment.

With the design of the support part 2, the pad body 22 can be disposed on the support arm 21, extended laterally, and pivotally connected by the cooperation of the attachment part 1 so as to support users at different angles. This design solves the problem that the existing fitness pad can only provide plane support and cannot meet the needs of users for multi-angle exercise.

The fitness pad can be mounted at a lower position of the gym rack through the attachment part 1 and used as a cushion or a seat, and a user can directly sit on it and exercise the upper body by grasping a fly or a Smith handle connected to the resistance system of the gym rack. Alternatively, the rope of the resistance system of the gym rack passes through the avoidance hole 15 and is connected to the connecting part. The rope is buckled to the buckle hole 51 on the leg exercise piece 42, so that the user sits on the pad body 22, the leg is fitted with the leg exercise piece 42, and leg exercise is performed by pulling the leg exercise piece 42 by the leg to pivot. With the design of the leg exercise part 4, the leg exercise piece 42 can be connected to the resistance system of the gym rack, and the resistance during leg exercise can be increased. This design effectively solves the problem that the existing fitness equipment lacks effective resistance adjustment function and can provide enough resistance to improve the exercise effect, especially when exercising legs.

In addition, the fitness pad can also be mounted on the position of the gym rack near the user's chest and abdomen. The user's chest and abdomen are supported by adjusting the angle of the pad body 22, and the user can lie prone on the pad body 22 and exercise by grasping the fly or Smith handle connected to the resistance system of the gym rack. The fitness pad can not only provide multi-angle support, but also realize the leg exercise function through the resistance system connected to the gym rack. This design meets the needs of users for diversified fitness training in a limited space and solves the problem of existing single-function fitness equipment.

In some embodiments (not shown), the present disclosure further provides a multifunctional gym rack, including: a gym rack providing an exercise frame with a plurality of selectable height position mounting positions and a resistance system for providing exercise resistance, which is mounted on the gym rack and used for providing resistance for the exercise performed on the gym rack; and the multifunctional fitness pad.

The multifunctional fitness pad can be detachably mounted on the gym rack, so that the gym rack and the fitness pad occupy small space and are convenient to carry; and the multifunctional fitness pad has reasonable structural design, small occupied space and is convenient for users to use in a home environment. This design overcomes the shortcomings of the existing fitness equipment, such as complex structure, large space occupation and unsuitability for use in home environment.

The technical means disclosed in the solution of the present disclosure are not limited to the technical means disclosed in the above embodiments but also include the technical solution composed of any combination of the above technical features. It should be pointed out that for those skilled in the art, several improvements and embellishments can be made without departing from the principle of the present disclosure, and these improvements and embellishments are also regarded as falling within the protection scope of the present disclosure.

What is claimed is:

1. A multifunctional fitness pad, comprising an attachment part comprising a mounting seat configured to be selectively attached to one of a plurality of selectable height positions on a gym rack and an extension arm extending transversely from the mounting seat, wherein a first end of the extension arm is connected to the mounting seat;

a support part comprising a support arm and a pad body, wherein the pad body is disposed on the support arm for supporting a user, and the support arm extends transversely relative to the attachment part and is pivotally connected to a second end of the extension arm to change a support angle for the user;

a releasable locking mechanism disposed between the attachment part and the support part and configured for locking the support arm to a required support angle;

a leg exercise part comprising an engagement seat and a leg exercise piece, wherein the engagement seat is mounted on the support arm at an opposing end of the support arm relative to the extension arm, and a proximal end of the leg exercise piece is pivotally connected to the engagement seat to provide a leg exercise function; and a connecting part is disposed on the leg exercise piece distally relative to the engagement seat for being selectively connected to a gym rack resistance system by the user to increase a pivoting resistance of the leg exercise piece during leg exercise;

wherein the leg exercise part, the support arm, and the extension arm are coplanar with each other piece for being selectively connected to a gym rack resistance system by the user to increase a pivoting resistance of the leg exercise piece during leg exercise.

2. The multifunctional fitness pad according to claim 1, wherein the mounting seat comprises a movable pin, a mounting frame and a positioning pole disposed on an inner side of the mounting frame, wherein the movable pin is configured to be inserted into the mounting frame.

3. The multifunctional fitness pad according to claim 1, wherein the extension arm is provided with an avoidance hole.

4. The multifunctional fitness pad according to claim 1, wherein one end of a support arm is pivotally connected to the attachment part, another end thereof is provided with a telescopic movable arm, and the engagement seat is mounted on the support arm through the movable arm.

5. The multifunctional fitness pad according to claim 4, wherein the support arm is sleeved outside the movable arm, and the movable arm is provided with a plurality of positioning holes along a telescoping direction; and the support arm is provided with a locking bolt which can be inserted into one of the positioning holes to lock a protruding length of the movable arm.

6. The multifunctional fitness pad according to claim 4, wherein a second T-shaped frame is disposed on the engagement seat, and two sides of second T-shaped frame are provided with second protective foams.

7. The multifunctional fitness pad according to claim 1, wherein the leg exercise piece comprises a third T-shaped frame, which comprises a swingarm and a crossbar, wherein the swingarm is rotatably connected to the engagement seat through a pivot shaft, and a middle part of the crossbar is mounted on the swingarm; and two sides of the crossbar extend to the outside of the swingarm, and two sides of the crossbar are provided with third protective foams.

8. The multifunctional fitness pad according to claim 7, wherein the swingarm is provided with a plurality of mounting positions for mounting the crossbar along a length direction, and the crossbar is detachably mounted in any mounting position.

9. The multifunctional fitness pad according to claim 7, wherein a side of the engagement seat near the swingarm is provided with a buffer pad for buffering the impact from the swingarm.

10. The multifunctional fitness pad according to claim 1, wherein the connecting part comprises a buckle hole disposed on the leg exercise piece, and the buckle hole is configured for connecting a resistance system to increase the pivoting resistance of the leg exercise piece.

11. The multifunctional fitness pad according to claim 1, wherein the releasable locking mechanism comprises a locking disc disposed on the support part and a clamping pin disposed on the attachment part, and a plurality of pivot holes for inserting the clamping pin are provided on the locking disc along a rotation direction of the support part.

12. A multifunctional fitness pad, comprising:

an attachment part configured to be selectively attached to one of a plurality of selectable height positions on a gym rack; and a support part comprising a support arm and a pad body, wherein the pad body is disposed on the support arm for supporting a user, and the support arm extends transversely relative to the attachment part and is pivotally connected to the attachment part to change a support angle for the user; and a releasable locking mechanism disposed between the attachment part and the support part and configured for locking the support arm to a required support angle; and a leg exercise part comprising an engagement seat and a leg exercise piece, wherein the engagement seat is mounted on the support arm, and the leg exercise piece is pivotally connected to the engagement seat to provide a leg exercise function; and a connecting part is disposed on the leg exercise piece for being selectively connected to a gym rack resistance system by the user to increase a pivoting resistance of the leg exercise piece during leg exercise;

wherein the attachment part comprises a mounting seat attachable to the gym rack and an extension arm extending transversely relative to the mounting seat, and the support arm is pivotally connected to an end of the extension arm away from the mounting seat;

wherein a first T-shaped frame is detachably mounted on the extension arm, and two sides of the first T-shaped frame are provided with first protective foams.

13. A multifunctional gym rack, comprising:

a gym rack provided with a plurality of selectable height position mounting positions; and a plurality of mounting positions with selectable height positions;

a resistance system mounted on the gym rack and configured for providing a resistance for an exercise carried out on the gym rack;

an attachment part comprising a mounting seat selectively attached to one of a plurality of selectable height positions on the gym rack and an extension arm extending transversely from the mounting seat, wherein a first end of the extension arm is connected to the mounting seat;

a support part comprising a support arm and a pad body, wherein the pad body is disposed on the support arm for supporting a user, and the support arm extends transversely relative to the attachment part and is pivotally connected to a second end of the extension arm to change a support angle for the user;

a releasable locking mechanism disposed between the attachment part and the support part and configured for locking the support arm to a required support angle;

a leg exercise part comprising an engagement seat and a leg exercise piece, wherein the engagement seat is mounted on the support arm at an opposing end of the support arm relative to the extension arm, and a proximal end of the leg exercise piece is pivotally connected to the engagement seat to provide a leg exercise function; and a connecting part is disposed on the leg exercise piece distally relative to the engagement seat for being selectively connected to the resistance system by the user to increase a pivoting resistance of the leg exercise piece during leg exercise;

wherein the leg exercise part, the support arm, and the extension arm are coplanar with each other.

* * * * *